United States Patent [19]

Kadar

[11] Patent Number: 4,760,942

[45] Date of Patent: Aug. 2, 1988

[54] BOOT LIFTER FOR ELDERLY AND HANDICAPPED

[76] Inventor: Sandor Kadar, 84 Lakeview Ter., P.O. Box D-201, Sandy Hook, Conn. 06482

[21] Appl. No.: 100,404

[22] Filed: Sep. 24, 1987

[51] Int. Cl.[4] ..... A47G 25/86

[52] U.S. Cl. ..... 223/114

[58] Field of Search ..... 223/113, 114, 115, 116, 223/117

[56] References Cited

U.S. PATENT DOCUMENTS

| | | | |
|---|---|---|---|
| 36,831 | 11/1862 | Bourn | 223/116 |
| 143,408 | 10/1873 | Dorsett, Jr. | 223/114 |
| 199,557 | 1/1878 | Lauffer | 223/116 |
| 209,091 | 10/1878 | Tyson | 223/114 |
| 3,652,009 | 3/1972 | Foster | 223/116 |
| 3,784,067 | 1/1974 | Hicks | 223/114 |

FOREIGN PATENT DOCUMENTS

| | | | |
|---|---|---|---|
| 36623 | 8/1886 | Fed. Rep. of Germany | 223/117 |
| 54462 | 11/1890 | Fed. Rep. of Germany | 223/113 |
| 696553 | 9/1940 | Fed. Rep. of Germany | 223/116 |
| 9684 | of 1908 | United Kingdom | 223/115 |

*Primary Examiner*—Robert R. Mackey

*Attorney, Agent, or Firm*—John R. Doherty

[57] ABSTRACT

A boot lifter comprising two elongated members arranged in side-by-side relation, the two members having forward and rearward ends and substantially flat coplanar surfaces thereon, each member having a cut away portion within its forward end forming a substantially U-shape opening adapted to receive the heel portion of the user's boot. Adjustable fastener means are provided for securing the two elongated members together while permitting relative movement of each member with respect to the other, whereby both the size and contour of the substantially U-shaped opening can be varied to fit most any type of boot. A pedestal member elevates the forward end of each member so that when placed on a level surface, the boot lifter is inclined at an angle which will accomodate placement of the idle foot or boot of the user to stablize the boot lifter when removing the boot.

3 Claims, 2 Drawing Sheets

FIG. 1
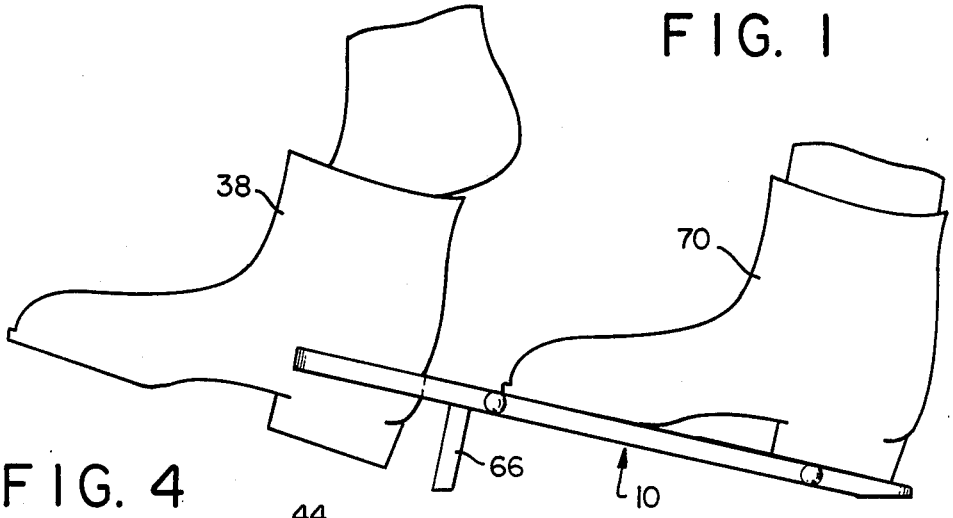
FIG. 4
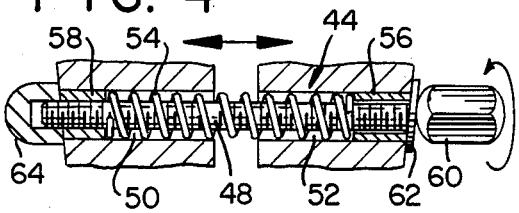
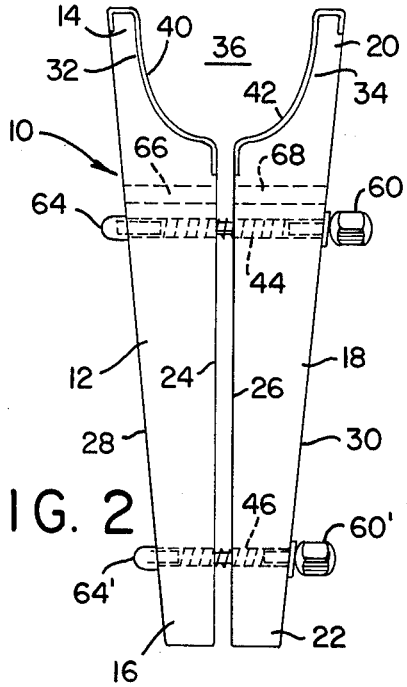
FIG. 2
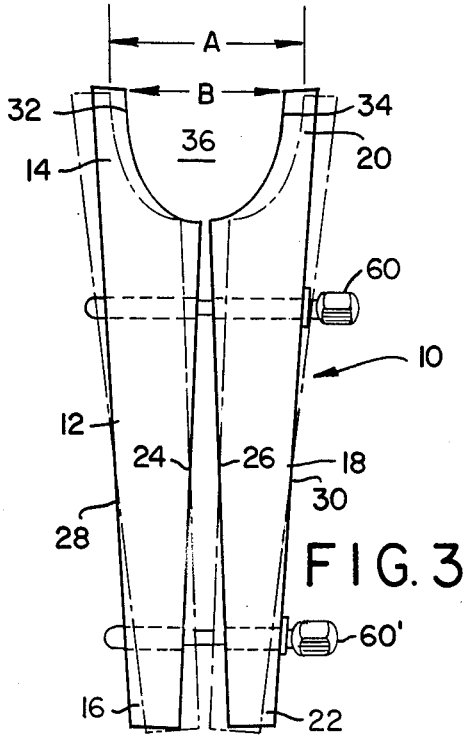
FIG. 3

BOOT LIFTER FOR ELDERLY AND HANDICAPPED

BACKGROUND OF THE INVENTION

This invention relates to a device for lifting a boot off of one's own foot and more particularly to a boot lifter which is adjustable to fit various sizes and shapes of boots.

The term "boot" is used herein in the broadest sense and is intended to include all types of footgear in general; however, the invention is directed particularly to boots which cover all or part of a person's leg, e.g. western-style boots and the like, and which are therefore the most difficult to remove by one's self.

In order to remove a boot from one's foot, it is customary to sit down on a chair and, while bending forward, place one leg over the opposite knee and lift the boot off the foot while grasping the boot with both hands. This procedure is awkward and can place a heavy strain on one's back. Accordingly, it is difficult, if not impossible, for this task to be performed by certain people such as the elderly or those with a handicap.

SUMMARY OF THE INVENTION

The present invention simplifies the above procedure for removing a boot from one's own foot by providing a boot lifter. The boot lifter comprises two elongated members arranged in side-by-side relation with their lateral edges opposite each other, the two members having forward and rearward ends and having substantially flat coplanar surfaces thereon, each member having a cut away portion within its forward end extending along the lateral edge thereof and forming together with the cut away portion within the other member a substantially U-shaped opening adapted to receive the heel portion of the user's boot. Adjustable fastener means are provided for securing the two elongated members together while permitting relative movement of each member with respect to the other, whereby both the size and contour of the substantially U-shaped opening can be varied to fit most any type of boot. A pedestal member is also provided for elevating the forward end of each member so that when the boot lifter is placed on a level surface, the members are inclined at an angle which will accomodate placement of the idle foot or boot of the user onto the coplanar surfaces in order to stablize the boot lifter when removing the boot.

BRIEF DESCRIPTION OF THE DRAWING

The invention will now be described in greater detail with particular reference to the accompanying drawing wherein:

FIG. 1 is a side elevational view of the boot lifter of the invention, showing the heel portion of one boot within the lifter for removal and the boot on the other foot of the user placed on the lifter to stabilize it;

FIG. 2 is a top plan view of the boot lifter;

FIG. 3 is a similar view showing in phantom lines the two elongated members adjusted to different positions relative to one another in order to accomadate different sizes and shapes of boots;

FIG. 4 is an enlarged, sectional view of part of the two elongated members showing the adjustible fastener means employed in the boot lifter.

DETAILED DESCRIPTION OF THE PREFERRED EMBODIMENT

Figure 5:
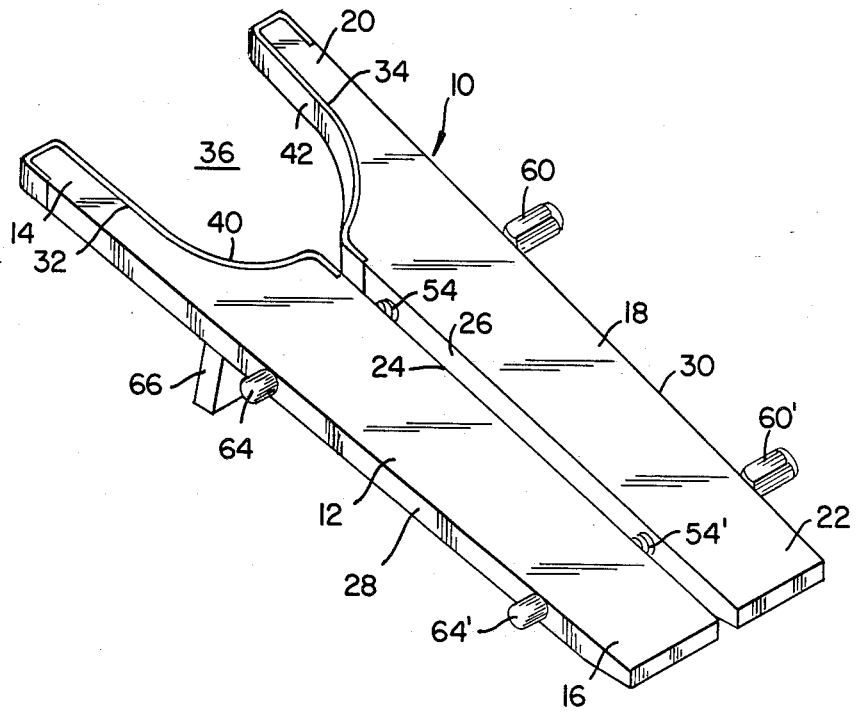
FIG. 5 is a perspective view of the boot lifter of the invention.

Referring now to the drawing in detail, wherein like numerals indicate like parts throughout the several views, there is shown a boot lifter 10 embodying the invention. As shown, the boot lifter 10 includes a first elongated member 12 having a forward end 14 and a rearward end 16 and a second elongated member 18 having a forward end 20 and a rearward end 22, the two elongated members 12 and 18 being arranged in side-by-side relation with their lateral edges 24 and 26 opposite one another and spaced a short distance apart.

The first and second elongated members 12 and 18 are complimentary and form essentially a mirror image of one another when viewed from the top as best seen in FIG. 2. Each of the elongated members 12 and 18 have a wide forward end 14, 20 and taper along the opposite lateral edges 28, 30, respectively, to a substantially narrower rearward end 16, 22.

The top surfaces of the two elongated members 12 and 18 are substantially flat and coplanar with a portion of each member being cut away within the forward end 14, 20 along the opposed lateral edges 24, 26 as shown at 32 and 34, respectively. The two cut away portions 32 and 34 together form a substantially U-shaped opening 36 for receiving and grasping the heel portion of the boot 38 as shown in FIG. 1. The inner surfaces of the cut away portions 32 and 34 are preferably lined with a soft material 40, 42, e.g., leather, in order to avoid damaging the boot.

Adjustable fastener assemblies 44 and 46 are provided for securing together the two elongated members 12 and 18. As shown in FIG. 4, each fastener assembly includes an elongated threaded bolt 48 extending through two aligned bores 50 and 52 which are drilled traversely through each elongated member 12, 18. Each of the aligned bores 50, 52 is made larger than the diameter of the bolt 48 and accomodates an elongated bias spring 54 extending coaxially around the bolt 48 between the two elongated members 12 and 18.

The bias spring 54 is held under compression between a tubular bushing 56 mounted within the extreme right hand side of the bore 52 and a threaded nut 58 mounted within the extreme left hand side of the other bore 50. The spring 54 urges the two elongated members 12, 18 in opposite directions and keeps the opposed lateral edges 24, 26 spaced apart from each other. The nut 58 is locked inside the bore 50 such as by pressing it into place and/or by glueing, in order to prevent its rotation.

The bolt 48 is provided with an enlarged square shaped bolt head 60 for ease in turning the bolt with the fingers. A large flat washer 62 is provided around the bolt 48 beneath the bolt head 60 and a hollow semi-spherical cap 64 is fixed as by glueing to the lateral edge 28 of the first elongated member 12. The cap 64 covers the end of the bolt 48 while allowing the bolt to move freely through the cap when adjustments are made in the fastener assembly.

The first and second elongated members 12 and 18 are each provided with a separate pedestal 66 and 68, respectively, which is secured such as by glueing to its underneath side close to the cut away portions 32 and 34 defining the U-shaped opening 36. The pedestals 66 and 68 elevate the forward end of each elongated member 12, 18 so that when placed on a level surface, the boot lifter is inclined at an angle which will easily accomodate placement of the idle boot 70 of the user onto the coplanar top surfaces of each member 12, 18. This placement of the idle boot or foot, as the case may be, serves to stabilize the boot lifter during removal of a boot.

An important feature of the invention resides in the ability of the boot lifter to be easily adjusted to any size or shape of boot by simply turning either one or both of the bolt heads 60, 60' of the two adjustible fastener assemblies 44, 46. It should be noted that one fastener assembly 44 is located close to the U-shaped opening 36 of the boot lifter while the other fastener assembly 46 is located within or close to the rearward ends 16, 22 of the elongated members 12 and 18. This arrangement of the two fastener assemblies 44, 46 permits the maxmium allowable movement of the two elongated members 12 and 18 with respect to one another and, accordingly, the greatest change in size and/or contour of the opening 36.

FIG. 3 shows in both solid and phantom lines the two extreme positions to which the elongated members 12 and 18 can be adjusted by turning the bolt heads 60 and 60' and also the two extreme widths "A" and "B" to which the U-shaped opening 36 can be adjusted to accomodate different size boots.

The two elongated members 12, 18 and the pedestals 66, 68 can be made of wood, preferably a hard wood such as maple or oak, for example, or they can be molded together in one piece from a suitable plastic material.

Thus, the invention provides a novel boot lifter for removing a boot from one's foot by simply placing the heel of the boot within an adjustible U-shaped opening of a predetermined size and contour to grasp the boot firmly while positioning the other idle boot or foot on top of the boot lifter to stabilize the boot lifter and then pull the foot until it is released from inside the boot. The procedure does not require the user to bend forward or otherwise place a heavy strain on the back nor does it require the user to employ his or her arms and hands in removing the boot.

What I claim is:

1. A boot-lifter comprising, in combination:

first and second elongated members arranged in side-by-side relation with their lateral edges opposite each other, said first and second members having forward and rearward ends and having substantially flat coplanar surfaces thereon, each of said members having a cut away portion within its forward end extending along the lateral edge thereof and forming together with the cut away portion within the other member a substantially U-shaped opening adapted to receive the heel portion of the user's boot;

adjustable fastener means located adjacent to said forward and rearward ends of said first and second elongated members, each of said fastener means including an elongated bolt extending through aligned bores disposed transversely in said first and second elongated members for securing said members together and a bias spring urging said members apart, the arrangement of said bolt and bias spring being such as to permit relative movement of each member with respect to the other, whereby both the size and contour of said substantially U-shaped opening can be varied; and pedestal means for elavating the forward end of said first and second elongated members so that when said boot lifter is placed on a level surface, said members are inclined at an angle which will accomodate placement of the idle foot of the user onto said coplanar surfaces to thereby stabilize said boot lifter when removing a boot.

2. A boot lifter comprising, in combination:

first and second elongated members arranged in side-by-side relation with their lateral edges opposite each other, said first and second members having forward and rearward ends and having substantially flat coplanar surfaces thereon, each of said members having a cut away portion within its forward end extending along the lateral edge thereof and forming together with the cut away portion within the other member a substantially U-shaped opening adapted to receive the heel portion of the user's boot;

first and second adjustable fastener means located adjacent to said forward and rearward ends of said first and second elongated members, respectively, each of said fastener means including an elongated bolt extending through aligned bores drilled transversely in said first and second elongated members for securing said members together, a bias spring coaxially mounted around said bolt and urging said members apart, a nut securing one end of said bolt in one bore and a bolt head affixed to said bolt for turning said bolt and adjusting the position of each member with respect to the other member; and pedestal means for elevating the forward end of said first and second elongated members so that when said boot lifter is placed on a level surface, said members are inclined at an angle which will accomodate placement of the idle foot of the user onto said coplanar surfaces to thereby stabilize said boot lifter when removing a boot.

3. A boot lifter according to claim 2, wherein the edges of said cut away portions forming said substantially U-shaped opening are lined with a soft material.

* * * * *